US005213443A

United States Patent [19]

Hemperly et al.

[11] Patent Number: 5,213,443

[45] Date of Patent: May 25, 1993

[54] FLEXIBLE WINDSURFING RAMP

[76] Inventors: Mike K. Hemperly, 59-197 Ke Nui Rd.; Kenneth D. Hill, 58-025 Kapuai Pl., both of Haleiwa, Hi. 96712

[21] Appl. No.: 849,977

[22] Filed: Mar. 12, 1992

[51] Int. Cl.[5] ..... B63C 3/06

[52] U.S. Cl. ..... 405/3; 405/1

[58] Field of Search ..... 405/3, 1, 218, 219, 405/220, 221; 14/69.5, 71.3, 75

[56] References Cited

U.S. PATENT DOCUMENTS

| | | | |
|---|---|---|---|
| 2,336,140 | 12/1943 | Vogler | 405/219 |
| 3,500,978 | 3/1970 | Cormier . | |
| 3,817,364 | 6/1974 | Cormier . | |
| 4,037,421 | 7/1977 | Whitley, Jr. | 405/3 |
| 4,641,996 | 2/1987 | Seal | 405/3 X |
| 4,662,781 | 5/1987 | Tinkler . | |
| 4,678,366 | 7/1987 | Williamson | 405/1 X |
| 4,838,735 | 6/1989 | Warner | 405/220 |

FOREIGN PATENT DOCUMENTS 3524494 1/1987 Fed. Rep. of Germany .

2551665 3/1985 France .

*Primary Examiner*—Randolph A. Reese
*Assistant Examiner*—J. Russell McBee
*Attorney, Agent, or Firm*—Watson, Cole, Grindle & Watson

[57] ABSTRACT

A windsurfing ramp which is flexible so as to provide a spring action and optimize the translation of windsurfing craft velocity into launch trajectory. The windsurfing ramp is compact by design, easily transported and easily assembled and installed. The windsurfing ramp is safe and eliminates the possibility of a windsurf craft rudder catching on a portion of the ramp thus injuring a sailor or damaging the windsurf craft. The ramp is made up of a plurality of substantially parallel, spaced apart tubular members which are flexible under the weight of a windsurf craft and sailor. The support members are arranged in a planar configuration such that one side edge is submerged when disposed on a body of water while an opposite side edge is elevated in the water.

25 Claims, 7 Drawing Sheets

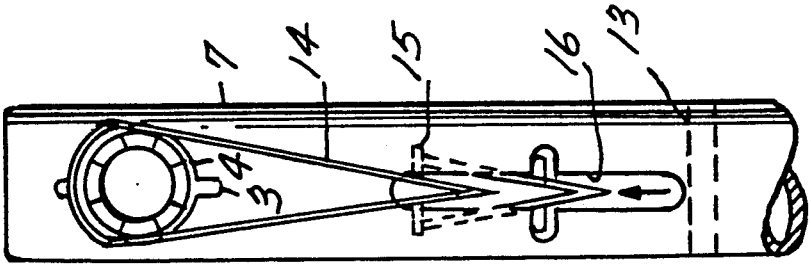
Fig. 6b.
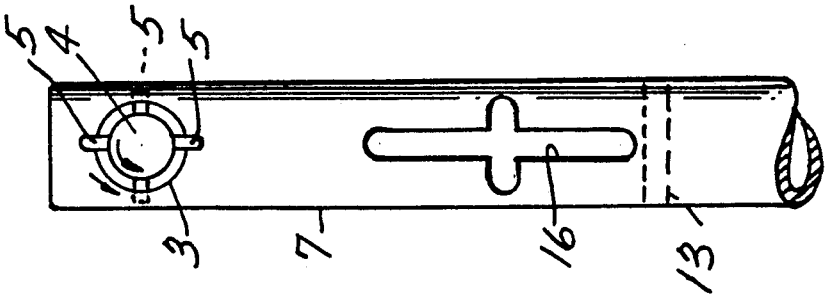
Fig. 6a.
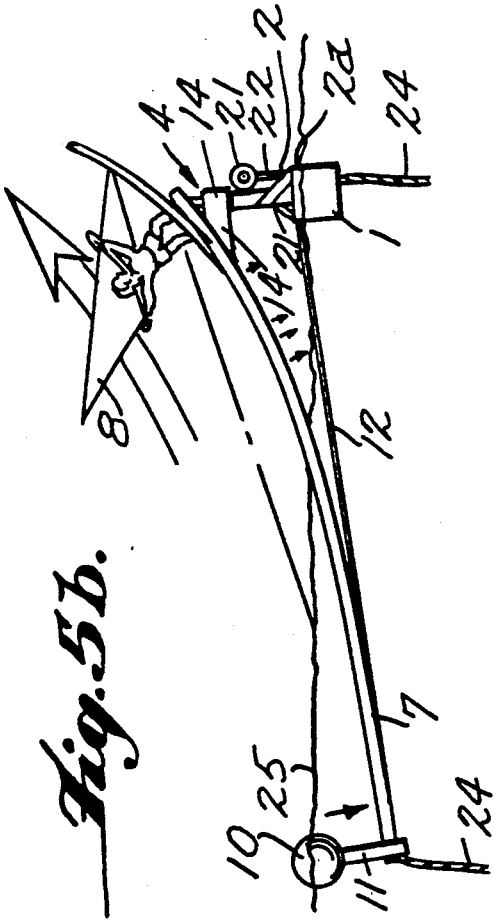
Fig. 5b.
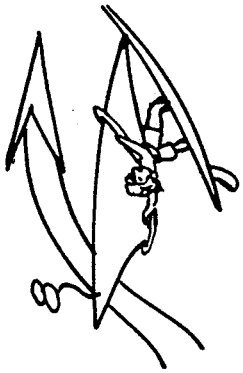
Fig. 5c.
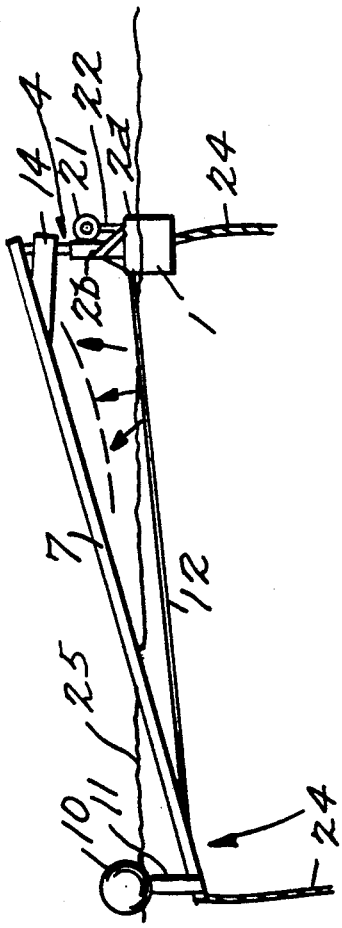

FLEXIBLE WINDSURFING RAMP

FIELD OF THE INVENTION

The present invention relates to a ramp for a windsurfing raft which enables windsurfers to launch themselves into an abovewater launch trajectory so as to perform aerial stunt maneuvers.

BACKGROUND OF THE INVENTION

Up until now, aerial maneuvers by windsurfing craft have only been possible when a proper combination of waves and wind of suitable size and velocity has been present. Many substantially flat bodies of water, such as lakes and rivers, are exposed to sufficient winds desirable for the windsurfing sport but usually lack the inclined surface provided by waves for the aerial launching of a sailor and his windsurfing craft.

Previous attempts have been made to produce an inclined surface which would allow windsurfers to execute aerial stunt maneuvers. German patent application no. 35 24 494 discloses a jumping ramp for windsurfing craft that do not have a keel or rudder. The ramp is a continuous surface and is not provided with any means to accommodate the bottom rudder of a windsurfing craft having a rudder or keel.

U.S. Pat. No. 4,662,781 discloses an inclined ramp having a surface comprising upstanding bristles which alone cannot accommodate the rudder of a windsurfing craft. In order to allow the fin of a windsurfing craft to pass over the ramp, a complex arrangement of water jets is used in conjunction with a powerful pump to create a continuous mound or ramp of water. The system is complicated, expensive and not easily transported.

One attempt to provide a windsurfing ramp with means to accommodate the rudder of a windsurf board is shown in French publication no. 2,551,665. This ramp shows a number of complex parallel rails having a plurality of vertical balls or rollers mounted on the surface thereof. The structure is rigid and complex as well as being costly to manufacture. The rails 1*a* are constituted of metallic sections or in hard plastic having a square, rectangular or U-shaped cross section. The ramp has a very small launching surface and vertical guide rollers which are designed to accommodate very thick crafts. Also, when using a windsurf craft having a rudder, any slight deviation from a completely flat take-off could lead to disaster as the rudder may catch on any of the rigid vertical support members 2.

The French patent, like U.S. Patent No. 4,662,781, discloses a rigid ramp which offers little or no flexibility under the weight of a windsurfing craft and its sailor.

A need therefore exists for a windsurf ramp which is safe, easy to manufacture and transport, cost effective, and able to provide substantial lift to a surf craft rider for spectacular aerial stunt maneuvers.

SUMMARY OF THE INVENTION

The present invention overcomes the problems of the prior art by providing a windsurfing ramp which is flexible so as to provide a spring-type action and optimize the translation of windsurf craft velocity into launch trajectory. The present invention also provides a windsurfing ramp which is compact by design, may be easily transported and is easily assembled and installed. The present invention also provides a safe windsurfing ramp which negates the possibility of a windsurf craft rudder catching on a portion of the ramp and causing injury to a sailor and damage to the windsurf craft.

The present invention achieves the foregoing by providing a ramp which comprises a plurality of substantially parallel, spaced apart tubular members which are flexible under the weight of a windsurf craft and sailor. The support members are arranged in a planar configuration such that two ends of the configuration are defined by adjacent end portions of the support members. One end of the ramp which is defined by a set of adjacent end portions is submerged in a body of water while the other end, defined by the opposite end portions of the support members, is elevated in the water. Vertical support posts are used to support the elevated end above the surface of a body of water. Guide members are provided between the vertical support posts and the support members such that the rudder of a surf craft will not catch on the vertical support posts as a windsurf craft is projected off the elevated end of the ramp.

The present invention is easy to manufacture and can be set up and dismantled quickly without the need for a variety of tools.

BRIEF DESCRIPTION OF THE DRAWINGS

The above and other objects of the present invention may be better understood with reference to the accompanying drawings in which:

FIG. 2*a* is a top view of the elevated end portion of a ramp according to the present invention showing the support members in phantom;

FIG. 5*a*–5*c* are successive views of the invention in use;

FIG. 6*a* is a detailed view of the twist lock feature of the vertical support post and the retention slot for the fin guard;

FIG. 6*b* is a detailed view of the fin guard apparatus of the present invention in place;

DESCRIPTION OF THE INVENTION

Figures 1A, 1B, 2C, 2D:
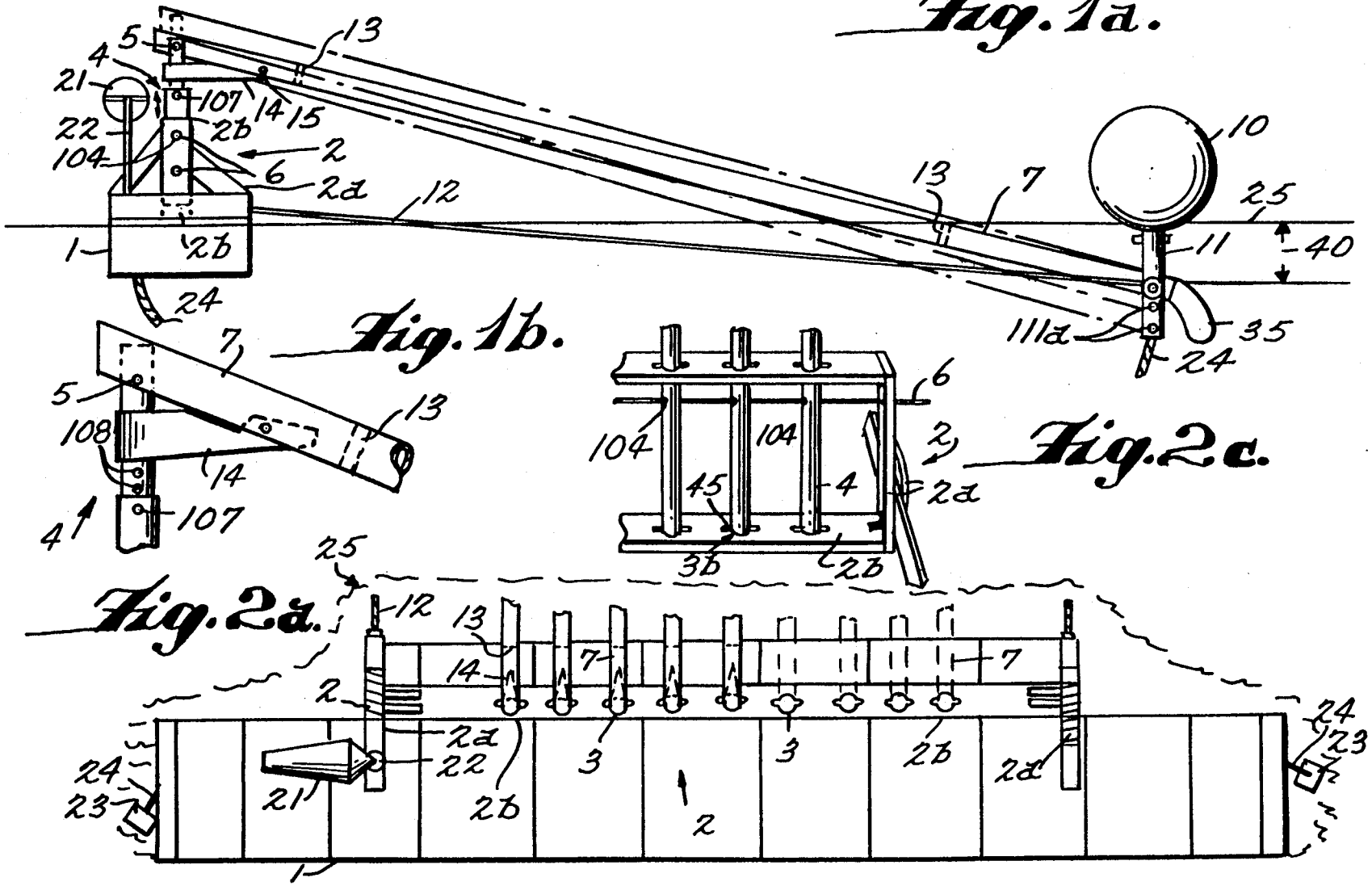
FIG. 1*a* is a side view of a jump ramp according to the present invention.
FIG. 1*b* is an enlarged view of a portion of the ramp in FIG. 1*a* showing details of the fin guard.
FIG. 2*c* is a front view of a portion of the ramp in FIG. 2*b* showing a two-crossbar arrangement and details of a side support member according to an embodiment of the present invention.

While the same reference numerals are used to depict similar parts of different embodiments of the present invention, it is to be understood that slight variations of each part can be made as exemplified by the different embodiments shown in the Figures. Components sharing the same reference numeral serve similar purposes.

The present invention relates to a ramp for a windsurfing craft comprising a plurality of substantially parallel flexible support members of substantially equal length spaced apart from each other at a distance. Means are provided to maintain the support members spaced apart. Each support member has a first end and a second end. The support members are arranged in a substantially planar configuration having a first end defined by adjacent first end portions of the support members and an opposite, second end defined by opposite adjacent second end portions of the support members. The substantially planar configuration of the ramp is also defined by first and second side edges opposite from one another and comprised of the two outermost support members.

The first end of the ramp is provided with means to force the first end below a surface of a body of water to define a submerged end when the ramp is disposed within a body of water. The second end, opposite the first end, is provided with means to force the second end above the surface of the body of water to define a elevated end when the ramp is disposed within the body of water. The distance between the support members is larger than a width of a rudder of a windsurfing craft and smaller than the width of a windsurfing craft.

Referring to the drawings, a ramp according to the present invention is supported upon a body of water 25 by a flotation means 1, which may be any number of well-known means used to float boating slips or the like. Floats may be used such as buoyancy billets, foam blocks, inflatable plastic chambers or other suitable means of floating the ramp. The ends of flotation device 1 normally extend four or more feet on both sides of the ramp device for stabilizing the ramp in rough water conditions.

A support platform 2 is secured by conventional means, e.g., nautical clips (not shown), or like means atop the flotation device 1. The platform is constructed of structurally-sound waterproof materials such as reinforced fiberglass materials, thermoplastics, nautical wood or the like. In the embodiment shown in FIG. 1*a*, 1*c* and 1*d*, the platform includes side support members 2*a* and at least one crossbar 2*b*. The crossbar 2*b* attaches to side support members 2*a* by means of wing-nuts and bolts, spring clips or other suitable means of securely assembling the platform 2. Preferably at least two crossbars are employed.

Figure 2B:
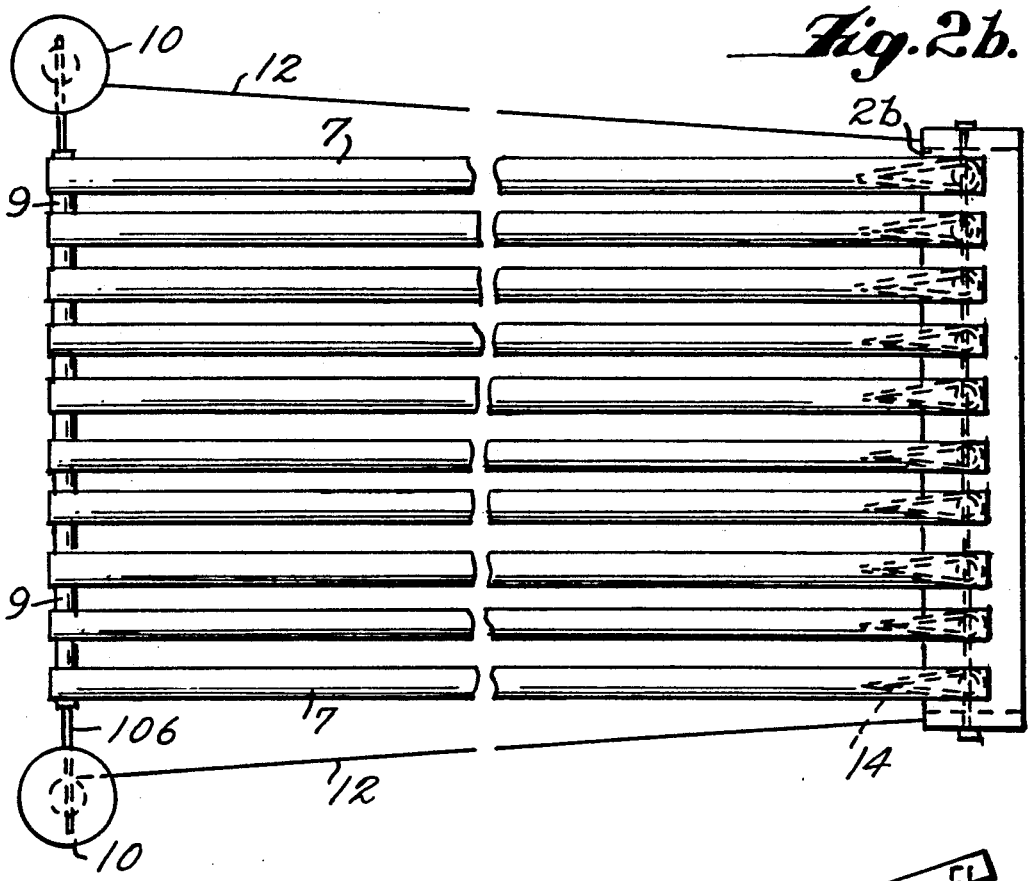
FIG. 2*b* is a top view of a ramp in accordance with an embodiment of the present invention.
Figure 1C:
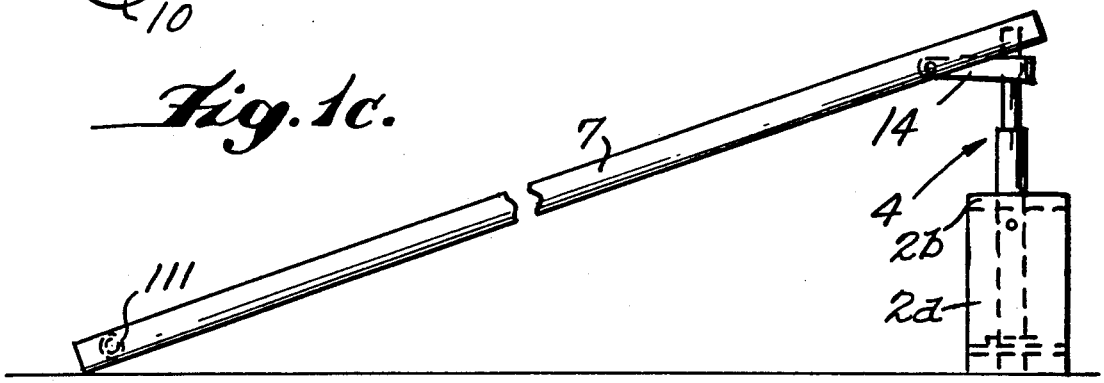
FIG. 1*c* is a side view of an embodiment of a ramp according to the present invention.
Figure 1D:
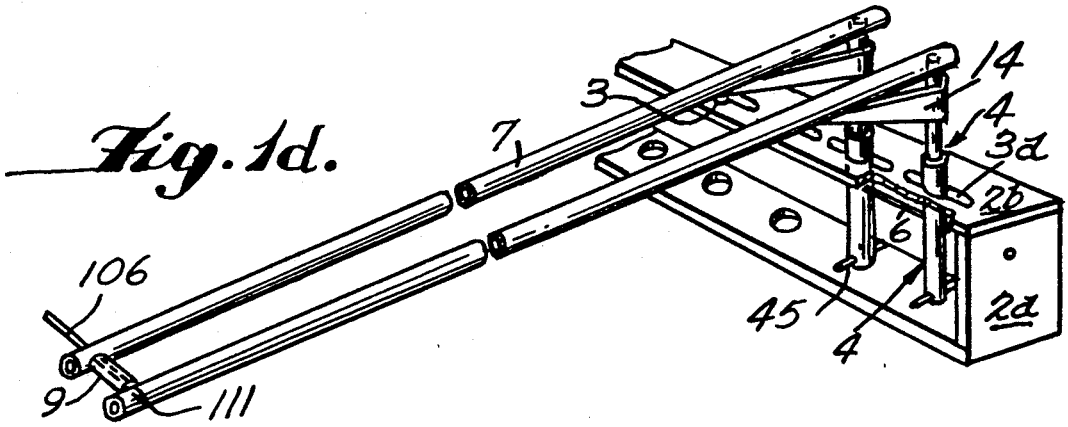
FIG. 1*d* is a perspective view of a portion of the embodiment in FIG. 1*c* showing a partial cut-away.

The embodiments shown in FIG. 1*a*, 1*c* and 1*d* employ two crossbars 2*b*, only the top one of which can be seen in FIGS. 2*a* and 2*b*. Two crossbars can be seen in the ramp shown in FIG. 2*c*. The crossbars 2*b* are provided with apertures 3 which are preferably spaced equidistantly eight to twelve inches apart along the lengths of the crossbars 2*b*. The apertures 3 are provided for the introduction of several vertical support members or posts 4, which may be fabricated of PVC pipe, anodized aluminum or the like. As seen in FIGS. 1*d* and 2*c*, the apertures 3 upon the upper crossbar are notched through their circumferences at notch 3*a* as shown to accommodate retention pins 45. The retention pins 45 are installed proximal to the bottommost rim of each post 4 as shown, such that each pin rests securely on the upper surface of the bottommost crossbar when the vertical support posts 4 are installed. The pins are preferably made of stainless steel, plastic or the like. A 2" to 3" length of each post 4 is inserted into a respective unnotched aperture 3*b* on the bottom crossbar. The stability, vertical alignment and security of each vertical support post 4 is ensured in this fashion. A retention bar 6 may then be inserted through apertures 104 of each member 4, as shown, and secured through side support members 2*a* by means of nautical bolts, wing nuts or the like for additional structural integrity. The retention bar is fabricated of any number of suitable, water-resistant materials. The embodiment shown in FIG. 1*a* uses two retention bars 6 to hold the vertical support posts in alignment.

Figure 4:
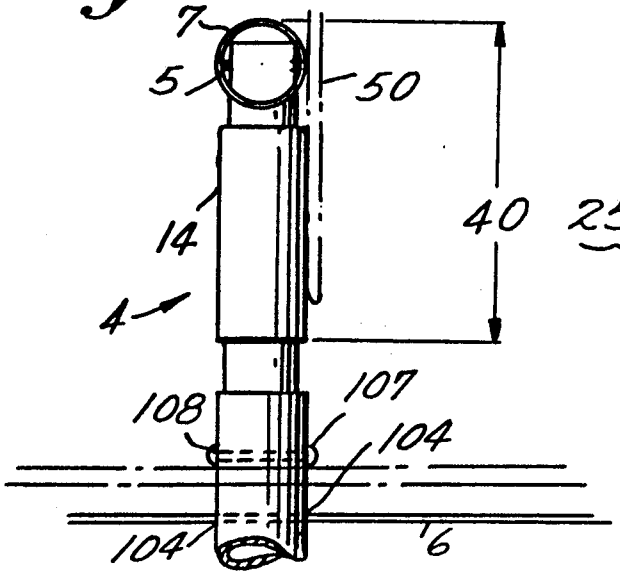
FIG. 4 is an end view of the elevated portion of a ramp according to the present invention.

Although the construction of vertical support posts 4 may be of a one-piece nature, the posts may also be made telescopic in nature by implementing a dual-pipe construction, for instance, a smaller diameter pipe inserted into a larger diameter pipe as shown in FIGS. 1*a* and 1*b*. A lock pin device 107, as shown in FIG. 4, or similar means may in turn be employed for locking the telescopic sections at the desired height setting. A multiplicity of matching apertures 108 within the sections of vertical support members 4 may be provided for varying the heights of the posts. As will become apparent, this embodiment facilitates ideal ramp surface conditions for advanced windsurfing stunts which require a specific pitch and/or yaw angularization upon launch, i.e., a staggered height of two or more vertical support members 4 can be provided. Such an arrangement is ideal for performing "barrel roll" and looping-type maneuvers as are known to be executed by sailors upon ocean-borne wave inclines. Of course, members 4 may remain of a standard height, with such an arrangement producing a ramp surface which would be ideal for novice and intermediate sailors to launch aerially therefrom.

Those skilled in the art will recognize that the addition of such measures as spring-load shock absorbers, oval- or square-shaped piping or like alterations to vertical support members 4 may, of course, be added and/or substituted without departing from the scope of the invention.

Ramp members or support members 7, which are preferably made of a semi-flexible piping such as PVC, thermoplastics of the like (said piping normally being at least three inches in diameter), are affixed to the tops of their respective vertical support posts 4 by means of apertures 3 disposed within the underside of each support member 7 and proximal to the end of same. Hollow plastic piping is particularly preferred. Notches may be provided for the insertion of additional retention pins 5, which may be installed proximal to the upper end of and through the upper circumference of vertical support posts 4. The vertical support posts 4 may then "twist-lock" into position and thereafter the telescoping component may be secured at a desired height. It is by such means that the elevating, uniform support and equidistant spacing of the support members 7 is achieved. Of course, alternate means may be employed to secure support members 7 to their respective support posts 4. These alternate means include, but are not limited to, nautical hinge clips, universal joints and spring clip assemblies.

The support members 7 may alternatively comprise inflatable structures, flat floatable sections, reinforced rubber hose, plastic sheeting or the like as long as a flexible ramp surface is provided. Although support members 7 are preferably of a one-piece construction, normally between 10 and 15 feet in length, a sectional assembly may be used in order to compact the members. If sectional members are used, the means for connecting the sections must not mar, indent or otherwise compromise the integrity of windsurf crafts or the safety of a sailor as they travel over the ramp. The support members 7 are preferably sealed in a watertight fashion by means of foam plugs 13 or the like, with the air chamber formed therein providing an additional flotation component. The ends of support members 7 are also preferably beveled for safety purposes.

Figure 3:
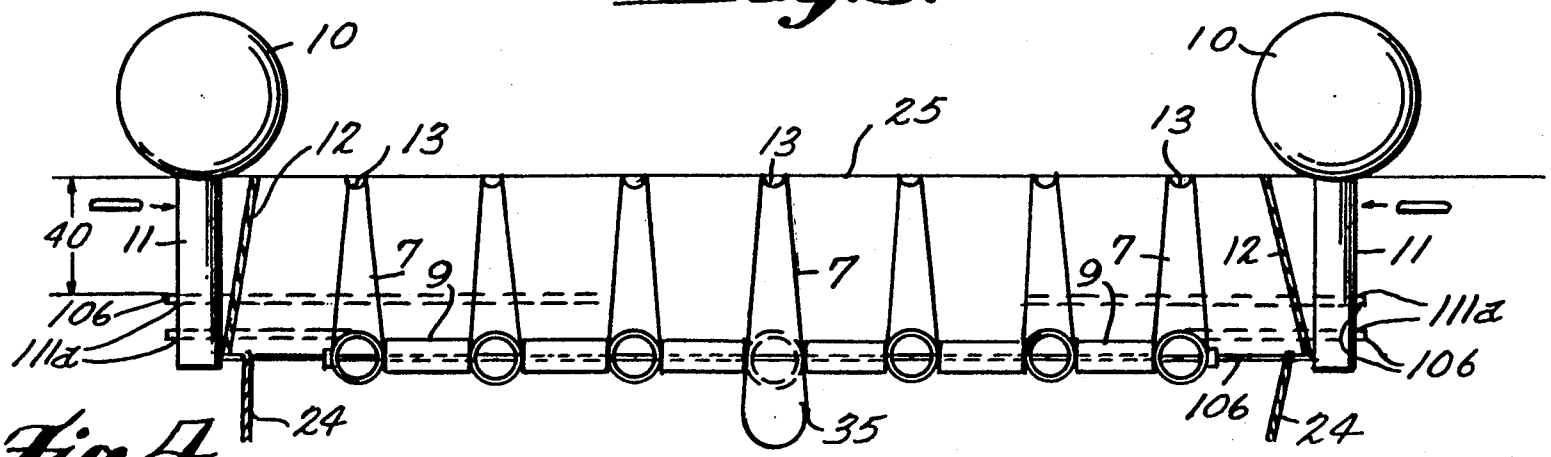
FIG. 3 is an end view of the submerged end portion of a ramp according to the present invention.

The submersible end of the ramp is provided with means to force the end below the surface of a body of water when disposed on the body of water. Means are also provided at the submersible end to space the support members apart from one another. As seen in FIG. 3, the submerged ends of support members 7 are spaced equidistant 8 to 12 inches, optimally, by means of spacer elements 9. The spacer elements may be made of any number of materials, such as hollow PVC piping, as shown, stainless lock-nuts or other appropriate means. A retention bar 106 is then inserted through apertures 111 disposed through, and proximal to, the ends of support members 7 and through spacer elements 9 placed between the support members. Spacer elements 9 may be affixed between ramp members 7 by means of nautical bolts or the like, the bolts being firmly secured on either side of the support members 7 and being tightened upon retention bar 106, as shown.

An excess of two or more feet of retention bar 106 at the end of the support members is exposed on both side edges of the ramp for the placement of front flotation buoys 10. The buoys 10 may be of any number of materials, shapes or sizes normal to such devices, provided their flotation capability provides ample support for the ramp while in use and does not block a windsurfing craft from sailing onto the ramp. Buoys 10 are affixed by bolts or other suitable means to buoy armatures 11 as shown in FIGS. 1*a* , 3 and 5*a*–5*c*. The armatures are fabricated of piping, reinforced plastic, stainless alloys or the like. Additionally, armatures 11 may have a multiplicity of attachment apertures 111*a* spaced equally along both armatures 11 for their placement by bolts, clips or other suitable means upon the extended ends of retention bar 106. This embodiment allows for variable ramp angularization in relation to the horizontally disposed body of water 25. The shallowest setting 40 should normally be no less than two feet to allow for the safe clearance of a surf craft rudder device 50 as the windsurfing craft sails over the ramp entrance. The variable setting of the heights of buoys 10 and their armatures 11, in relation to retention bar 106 as seen in FIG. 1*a* will, when the telescopic nature of vertical support post 4 is taken into account, allow for a multiplicity of angular/height combinations of the ramp device.

Reinforcing support devices 12 are affixed by well-known means to both ends of retention bars 106 and cleated or otherwise secured to side support members 2*a* as shown. The support devices are preferably made of nautical rope, spring coils, guide wires, elastomeric members or the like. Support devices 12 are employed in this fashion to ensure that the ramp device will not collapse as a windsurfing craft sails up and off the ramp. The devices 12 may also serve to some extent as a shock-absorption measure. Of course, more than the two support devices 12 depicted may be utilized as deemed necessary for specific wind conditions or like consideration, i.e., device 12 may be positioned in tandem, criss-cross or other manner as deemed necessary for unusual sailing conditions and extremely heavy crafts and sailors.

In another embodiment of the present invention, rudderdeflecting cross members, herein referred to as fin guards 14, are provided on a windsurfing ramp, preferably as shown, to ensure the safe clearance of a windsurf craft rudder or keel. The fin guards may be constructed of rigid and smooth thermoplastics, reinforced fiberglass or similar high-strength, low-resistance materials which will give minimal friction or hindrance to the rudder upon encounter. Retention pins 15 of stainless steel or the like are installed through the ends of the fin guards which connect to the support members secured thereto as shown best in FIG. 6*b*. As seen in FIGS. 6*a* and 6*b*, the fin guard 14 may be inserted into a fin guard aperture 16 on a corresponding support member 7. The fin guard is biased toward aperture 3 on the vertical support post 4 to secure the fin guard 14 on its respective support member. The retention pin 15 serves not only to hold the fin guard 14 in position but also as a pivot point for the guard as it is moved by both body of water 25 and sailing actions upon the ramp. As seen in FIGS. 4 and 6*b*, the trailing end of fin guard 14 may now be securely cradled around the circumference of its individual vertical support post 4.

Figure 9:
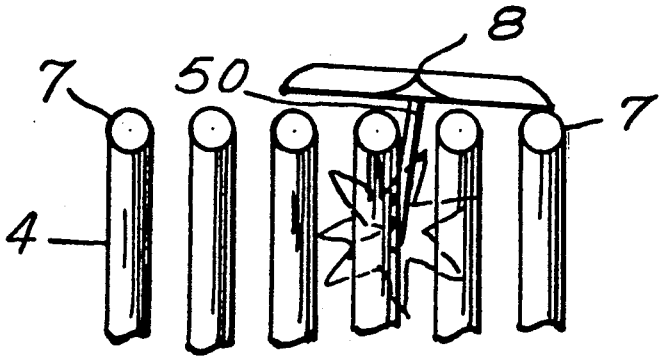
FIG. 9 is an end view of a ramp without a fin guard, showing a possible point of contact with a windsurf craft rudder.

The guard 14 possesses a curvature which gives the guard a snug fit around post 4. The deflective foil thus created ensures the rudder on a windsurf craft to exit the ramp safely upon launch with minimal possibility of collision, as depicted in FIG. 9, of the rudder with vertical support post 4 or other components of the ramp. Additionally, retention pins (not shown) may be implanted through the back of guard 14 and through post 4 for additional stability as needed. It will be recognized by those skilled in the art that the dimensions, shape and materials used in the fabrication of fin guards 14 may vary provided the length and maximum stress loads of rudders normally installed upon windsurf craft are taken into consideration, thereby ensuring successful rudder deflection and the resultant safety of the sailor and protection of the craft.

Although the smooth surfaces of support members 7 have been found optimal in allowing windsurf craft to traverse thereupon with minimal friction, the normally hard surfaces of support members 7 may possibly, after prolonged ramp usage, scratch, mar or otherwise affect the bottom hull surface of windsurf craft. A resilient padding, such as 2" polyethylene, closed-cell, high-density rubber or the like, has been found to be successful in counteracting this action. However, such padding normally does not possess the necessary slippery, low-resistance texture as has been found preferable for optimum use by windsurf craft and as is provided by preferred support members.

Figures 7A, 7B, 8A, 8B:
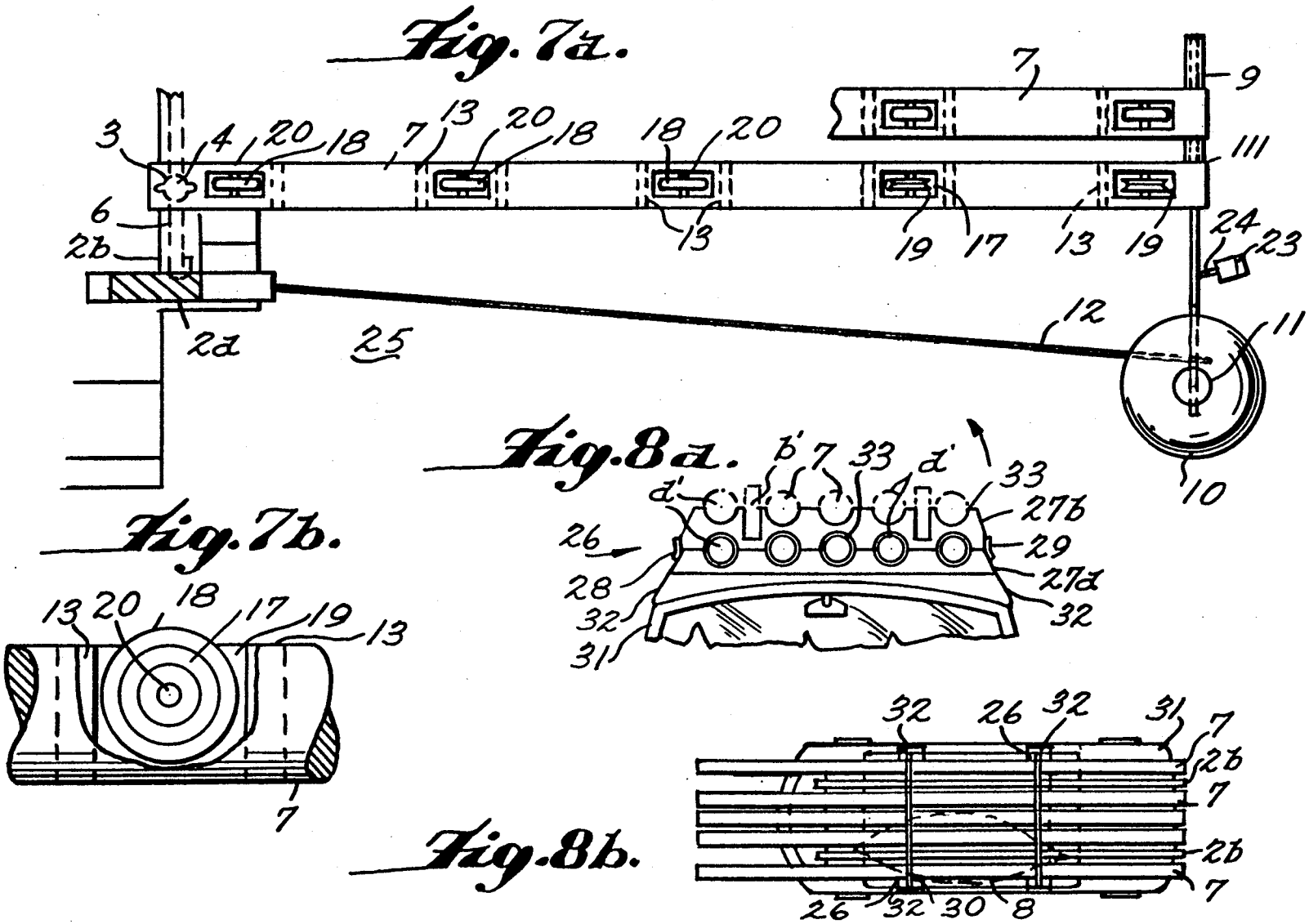
FIG. 7*a* is a top view of a portion of an alternative embodiment according to the present invention showing roller means.
FIG. 7*b* is a partial cutaway view of a roller means shown in FIG. 7*a*.
FIGS. 8*a* and 8*b* are an end view and top view, respectively, of an automotive transport rack for a ramp according to the present invention.

In one preferred embodiment as seen in FIGS. 7*a* and 7*b*, rotational hubs 17 may be used in conjunction with padding 18 to provide a ramp surface which not only has low-friction but also gently cushions the bottom of windsurf craft as it ascends the support members 7. Optimally, the hubs are spaced two to four feet apart along support members 7. The padding hubs 17 are preferably made of a resilient material such as thermoplastic materials, or of stainless steel or other rust-resistant, high-load capacity materials and, as seen in FIG. 7*b*, are preferably of a diameter and width which not only supports a windsurf craft but also allows for free rotation within the support member through individual wheel wells 19. The subsequent flexation of support members 7 is also to be taken into account with regard to the nature and dimensions of padding hubs 17 and wheel wells 19 to avoid pinching the hubs or other hindrances to the rotation thereof.

An axle and bearing assembly 20, preferably being fabricated of similar materials as 17 and possessing adequate structural integrity for maximum anticipated stress loads, is provided through each padding hub 17 as shown. The axle and bearing assembly 20 is affixed by rivets (not shown), or other suitable means to the sidewalls of support members 7 for safety purposes. Padding 18, having a suitable thickness and generally the same width as 17, may be glued or otherwise affixed to respective padding hubs to form padded hubs. The padding is made of a resilient material to cushion and protect the windsurf craft. The padding 18 may be fabricated in a circular one-piece fashion similar to that of an automotive tire, so that not only is the initial installment expedient, but also, as the padding 18 wears down or otherwise becomes unusable, replacement is easily realized by simply refitting a new padding 18 on the hub 17.

Optimally, the hubs are recessed and concave along their outer rims, as shown, to positively retain padding 18 upon their surfaces. As may be seen in FIGS. 7*a* and 7*b*, additional foam plugs 13 may be installed on both sides of wheel wells 19 so that the flotational integrity of support members 7 is preserved. Of course, the present invention remains operational without this embodiment, with the padding system described being primarily for the preservation of specially crafted models of windsurf craft. Many windsurfing boards have been known to cost several thousand dollars and their protection is of utmost concern to their owners and riders.

The ramp of the present invention is optimally positioned perpendicular to wind direction in use and may be situated with the inclined surface allowing for either starboard or port tack aerial maneuvers, e.g., the ramp may be facing toward or away from the shoreline as desired. Other ramp angles relative to wind direction are, of course, possible and may be implemented for enabling stunt maneuvers. A windsock 21 and post 22 may be installed as shown and have been found useful in accurate ramp positioning in relation to wind direction. The windsock 21 also serves as a wind strength indicator, with a limp windsock 21 showing approaching sailors that a jump should most likely not be attempted. The ramp is preferably positioned in an area upon a body of water of adequate depth, normally being at least six feet or more so as to cushion the sailor if he should be thrown from the windsurfing craft or otherwise have an unsuccessful jump attempt.

To assure proper placement and retention of the ramp upon the body of water, anchors 23 and nautical ropes 24 may be implemented as shown. The anchor ropes 24, which are affixed by well-known means such as nautical cleats or the like, may be adjusted in length and tautness with respect to such variables as specific mooring depth, tidal strength, rip current patterns and like factors. This is especially advantageous in properly submerging the ramp entrance area and, in conjunction with buoys 10, as seen in FIG. 5*b*, to keep the ramp from capsizing during normal use. These embodiments enable the windsurf craft 8 and its sailor to make a clean and safe transition from the horizontally disposed body of water 25 onto and over the ramp with minimum danger or disturbance to the windsurfing craft 8 or the individual sailor.

Figure 5A:
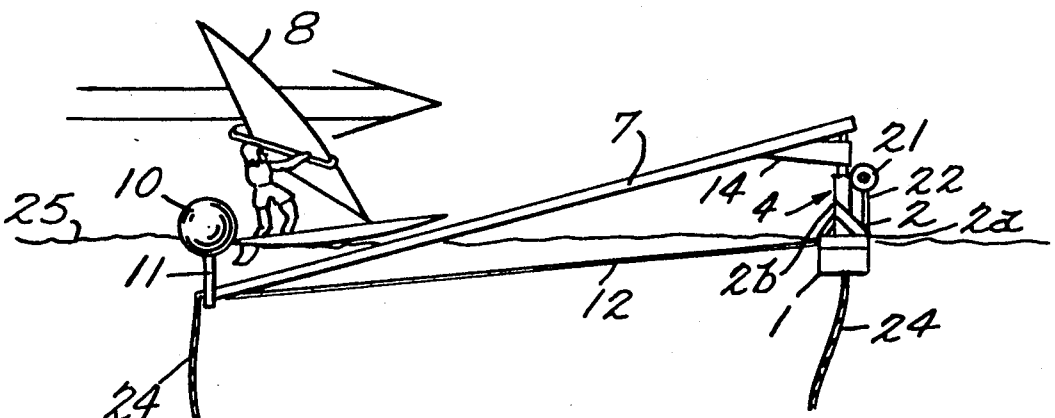

As seen in FIGS. 5*a*–5*c*, the windsurf craft 8 may slide upon support members 7 and up the ramp, with the rudder device on the craft tracking in between two of the support members. As it makes its way up support members 7, as seen in FIG. 5*b*, the combination of the weight of windsurf craft 8 and its sailor, and the velocity with which they encounter the ramp device, causes the flexible members 7 of the ramp surface to yield accordingly. This slight flexing of the ramp members 7 upon introduction of the windsurf craft 8 to the ramp serves not only to act as a shock absorbing measure for the sailor but also causes the ramp to assume a position of parabolic angularization similar to that of an actual wave crest. This is advantageous in that this angled flexation of members 7 subsequently forms an optimum arc of ascent, causing windsurf craft 8 to be launched into a trajectory comparable to that afforded by a natural ocean wave. The trajectory and ramp arc may, of course, be affected by the preset angle and height of either or both ends of the ramp. Also, the flexible support members 7 act as springs to propel the sailor and windsurf craft higher into the air than can be achieved with a non-flexible ramp.

As the sailor and his craft 8 depart aerially from the ramp device, fin guards 14 assure safe rudder clearance, allowing the sailor to be propelled into an aerial launch trajectory. The present invention may be constructed so as to be extended to great widths, allowing the windsurf ramp to accommodate a great number of sailors simultaneously.

According to alternative variations of the present invention, support members 7 may be bent or formed so as to provide a variety of jump surfaces. As can be seen in FIGS. 1*a*, 3, 10, 11 and 12, various modifications can be made to the support members.

As can be seen in FIGS. 1*a* and 3, the submerged ends of support members 7 can be bent downward for safety purposes. Alternatively, a safety fitting 35 can be attached at the submerged end of each support member. FIG. 3 only shows one safety fitting 35 as an example. The safety fitting ensures the safety of a sailor should the sailor be ejected from the craft or otherwise have a fall near the ramp entrance.

Figure 10:
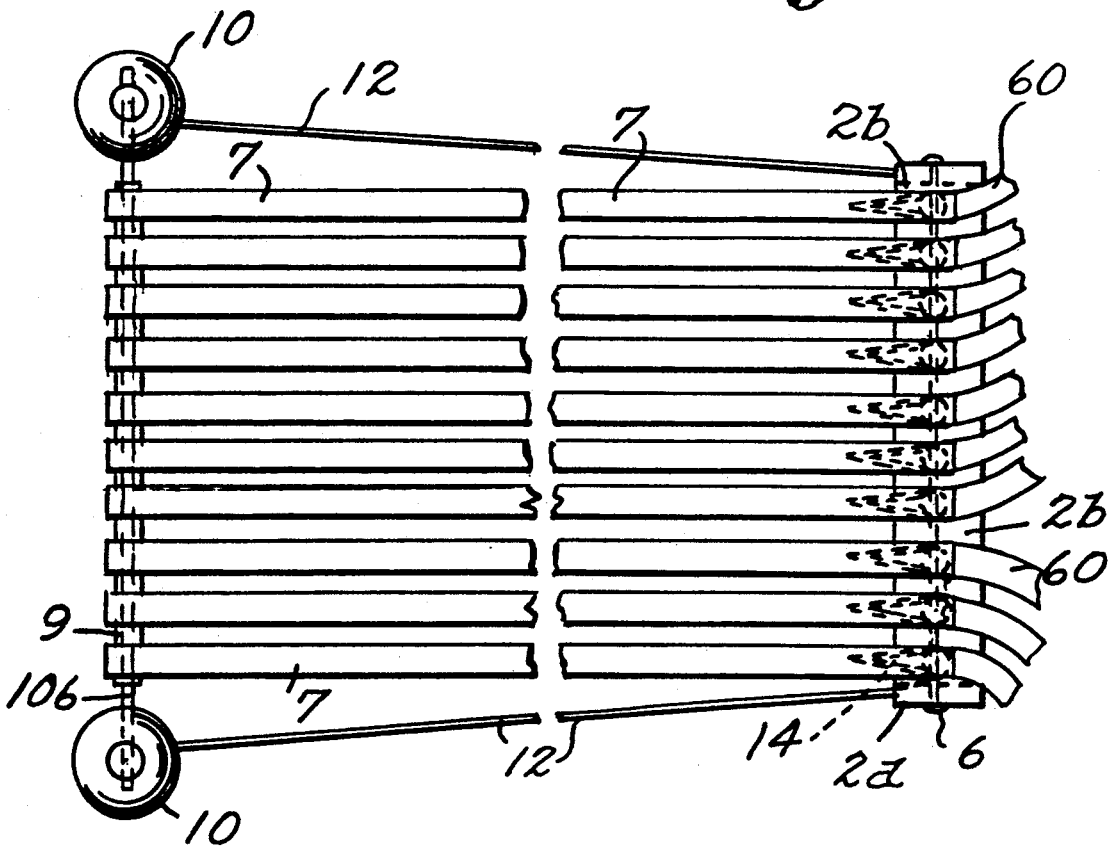
FIG. 10 is a top view of another embodiment according to the present invention.
Figure 11:
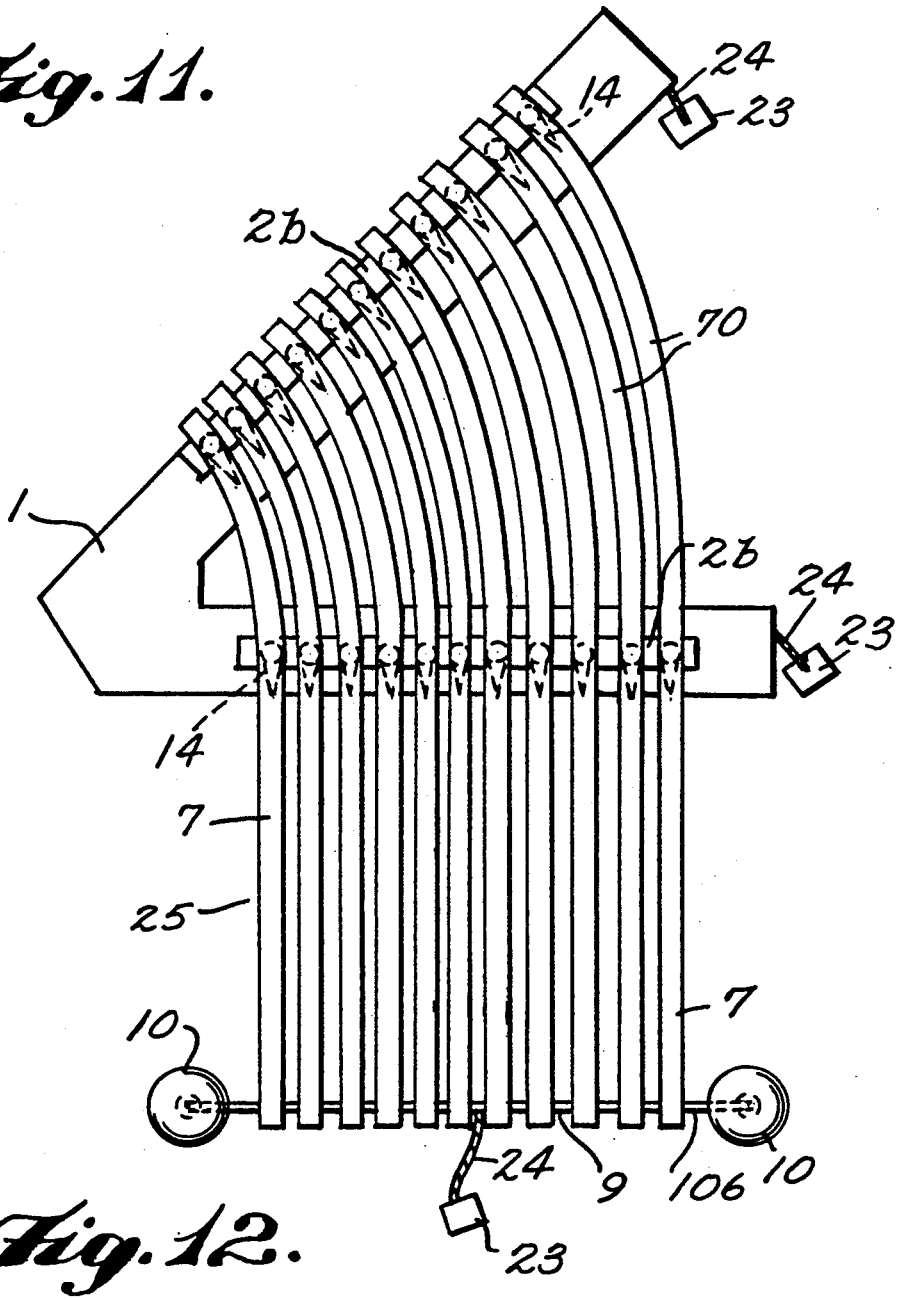
FIG. 11 is a top view of another embodiment according to the present invention.
Figure 12:
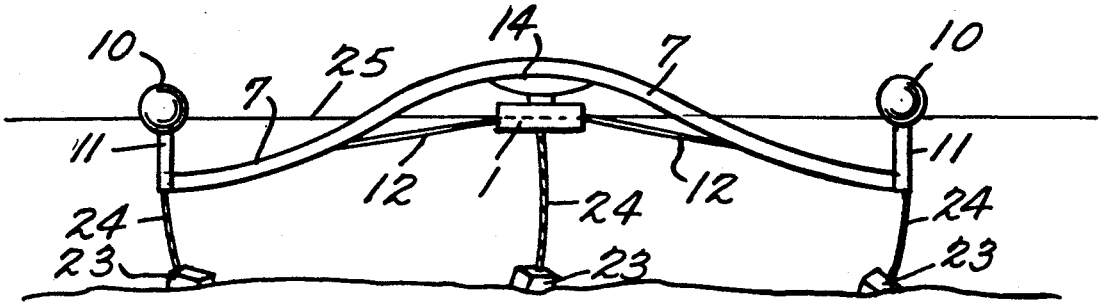
FIG. 12 is a side view of another embodiment according to the present invention disposed on a surface of a body of water.

FIGS. 10, 11 and 12 show other modifications to the support members 7. The elevated ends of support members 7 may be bent in the shape of a plane or continuous curve. Extensions 60 shown in FIG. 10 and extensions 70 shown in FIG. 11 may be connected or integrally formed with support members 7 at their elevated ends to provide a jump surface which is well suited for performing windsurfing stunts encompassing arcing aerial maneuvers. Extensions 60 may curve in either or both directions perpendicular to the support members, as shown. Extensions 70 shown in FIG. 11 are further supported by the offset placement of additional ramp components, e.g. floats 1, supports 4, platform 2, etc. Difficult banking maneuvers are thus made possible.

FIG. 12 shows another embodiment wherein the support members are symmetrically bent along a vertical plane and supported in the middle. With additional submerged end components a bi-directional ramp configuration is enabled for dual tack aerial stunts.

As will be recognized by those skilled in the art, the invention in the aforementioned design may be easily disassembled and compacted for transport. Automotive racks 26 fabricated of steel, plastic or the like, have been found useful in transporting the larger components of the present invention, namely support members 7 and crossbars 2*b*, although additional ramp components and windsurf craft 8 may be added to the load of the rack 26 as desired. As seen in FIGS. 8*a* and 8*b*, rack members 27*a* and 27*b* are joined to each other via a hinge joint 28, allowing member 27*b* to swivel up and allow the insertion of several support members 7 within the apertures a' provided thereon. When 27*a* is fully loaded, rack members 27*b* may swivel down, with the matching apertures a' provided upon its bottom side securely enclosing the diameters of each support member 7. A pressure clip-lock 29 or similar device is employed for the mating of 27*a* and 27*b* and ensures the security of the members 7 therein during transport. Additional apertures a' are provided atop rack member 27*b* for securing thereto the remainder of support members 7, with additional apertures b' for the transport of crossbars 2*b*. Rack straps 30, being made of nylon webbing or the like, are used for securing these and possibly other elements atop rack member 27*b*, with each strap 30 in turn being cinched down tight via spring rachet devices (not shown), pinch clips or the like. As seen in FIG. 8*b*, each auto rack 30 may be positioned parallel atop automobile 31 and secured thereon via rain gutter clamps 32, which are widely known and used for similar purposes. Additionally, a padding 33 may be provided within apertures a' and b' for protection of the invention during transport. This system allows the sailor to easily transport the disassembled invention to his favorite lake or river, with the less bulky components normally being stored in the trunk and/or back of the automobile.

The invention is not limited to the specific embodiments described and illustrated herein. It will be appreciated that various modifications, substitutions, adaptations or combinations may be made without departing from the spirit and scope of the invention defined in the appended claims.

What is claimed is:

1. A ramp for a windsurfing craft, said ramp comprising a plurality of substantially parallel flexible support members spaced apart from each other at a distance by means to maintain the support members spaced apart, said distance being larger than a width of a rudder of a windsurfing craft and smaller than a width of a windsurfing craft, each support member having a first end and a second end, said support members being arranged in a substantially planar configuration having a first end defined by adjacent first end portions of the support members and an opposite, second end defined by opposite adjacent second end portions of the support members, said substantially planar configuration also having first and second side edges opposite from one another and defined by two outermost support members, wherein said first end is provided with means to force said first end below a surface of a body of water to define a submerged end when said ramp is disposed within a body of water and wherein said second end, opposite said first end, is provided with means to force said second end above a surface of a body of water to define an elevated end when said ramp is disposed within a body of water, said flexible support members being sufficiently flexible so as to bend at the upper end thereof under the force of a windsurfing craft with a sailor thereon and to act as a spring as the windsurf craft and sailor leave the ramp to propel the windsurf craft and sailor high into the air.

2. A ramp as defined in claim 1, wherein said means to force said first end below a surface of a body of water comprises at least one anchor.

3. A ramp as defined in claim 1, wherein said means to force said second end above a surface of a body of water comprises at least one float.

4. A ramp as defined in claim 1, wherein said support members are tubular.

5. A ramp according to claim 4, wherein said support members are plastic.

6. A ramp according to claim 1, wherein said support members comprise polyvinyl chloride tubes.

7. A ramp according to claim 1, wherein each said support member is connected to a vertical support post at said second end of each said support member.

8. A ramp according to claim 7, wherein an uppermost portion of each vertical support post extends to a corresponding support member to form a first point of connection, and wherein a second point of connection is provided between each vertical support post and each corresponding support member by a cross member, one cross member connected to each said vertical support post at a location below the uppermost portion of said vertical support post and connected to each said support member at a location along said support member between said first and second ends of each support member.

9. A ramp according to claim 7, wherein said vertical support posts are connected to a common, continuous platform.

10. A ramp according to claim 9, wherein said platform is connected to said first end of said ramp by a reinforcing member.

11. A ramp according to claim 7, wherein each support member is connected to a corresponding vertical support post at a location such that the second end of each support member extends past each point of connection.

12. A ramp according to claim 7, wherein a height of each vertical support post can individually be adjusted.

13. A ramp according to claim 7, wherein said vertical support posts have different heights.

14. A ramp according to claim 7, wherein each said vertical support post comprises at least two post members which are telescopic in relation to each other so as to provide a vertical support post of varying heights.

15. A ramp according to claim 1, wherein said means to hold the members spaced apart comprises spacer members, one spacer member disposed between each support member along said first end of said ramp.

16. A ramp according to claim 15, wherein said vertical support posts are connected to a common, continuous platform.

17. A ramp according to claim 15, wherein a retention bar is provided which extends through the first end of each support member and through each spacer member, said retention bar maintaining said first ends and said spacer members in alignment.

18. A ramp according to claim 1, wherein at least one support member is provided with a plurality of resilient rolling means on a top surface thereof to reduce friction between a windsurf craft and said ramp.

19. A ramp according to claim 1, wherein each said support member is provided with a plurality of resilient rolling means on a top surface thereof to reduce friction between a windsurf craft and said ramp.

20. A ramp for a windsurfing craft, said ramp comprising a plurality of substantially parallel support members of substantially equal length spaced apart from each other at a distance by means to maintain the support members spaced apart, said distance being larger than a width of a rudder of a windsurfing craft and smaller than a width of a windsurfing craft, each support member having a first end and a second end, said support members being arranged in a substantially planar configuration having a first end defined by adjacent first end portions of the support members and an opposite, second end defined by opposite adjacent second end portions of the support members, said substantially planar configuration also having first and second side edges opposite from one another and defined by two outermost support members, said first end is provided with means to force said first end below a surface of a body of water to define a submerged end when said ramp is disposed within a body of water and said second end, opposite said first end, is provided with means to force said second end above a surface of a body of water to define an elevated end when said ramp is disposed within a body of water, wherein each said support member is connected to a vertical support post at said second end of each said support member and an uppermost portion of each vertical support post extends to a corresponding support member to form a first point of connection, and wherein a second point of connection is provided between each vertical support post and each corresponding support member by a cross member, one cross member connected to each said vertical support post at a location below the uppermost portion of said vertical support post and connected to each said support member at a location along said support member between said first and second ends of each support member.

21. A ramp according to claim 1, wherein said second end portion of each support member is curved laterally.

22. A ramp for a windsurfing craft, said ramp comprising a plurality of substantially parallel flexible support members of substantially equal length spaced apart from each other at a distance by means to maintain the support members spaced apart, said distance being larger than a width of a rudder of a windsurfing craft, each support member having a first end, a second end, and a middle portion, said support members forming a substantially humped configuration having a first end defined by the first end portions of the support members being substantially adjacent one another, said configuration having a second end defined by the second end portions of the support members being substantially adjacent one another, and said configuration further having a middle portion defined by the middle portions of the support members being substantially adjacent one another, said first and second ends of said configuration being provided with means to force said first and second ends of the configuration, respectively, below a surface of a body of water to define first and second submerged ends when said ramp is disposed on a body of water, said middle portion of said configuration being provided with means to force said middle portion of said configuration above a surface of a body of water to defined an elevated middle portion when said ramp is disposed on a body of water.

23. A ramp for a windsurfing craft comprising a plurality of elongated substantially parallel flexible support members having opposite ends, means for maintaining said support members spaced from one another by a distance larger than the width of the rudder of a windsurfing craft and smaller than the width of the windsurfing craft, said support members having upper support surfaces disposed substantially in a plane, means for forcing first ends of said support members below the surface of a body of water to define a submerged end of the ramp, means for forcing second opposite ends of said support members above ht surface of a body of water to define an elevated end of the ramp, and rudder deflecting means supported adjacent the second opposite ends of said support members for deflecting the rudder of a windsurfing craft toward the middle of the space between adjacent support members, said flexible support members being sufficient flexible so as to bend at the upper end thereof under the force of a windsurfing craft with a sailor thereon and to act as a spring as the windsurf craft and sailor leave the ramp to propel the windsurf craft and sailor high into the air.

24. A ramp according to claim 23, wherein said rudder deflecting means includes a tapered configuration tapering from a minimum lateral dimension to a maximum lateral dimension in direction toward said second opposite ends of the support members.

25. A ramp according to claim 23, wherein each of said rudder deflecting means includes first and second end portions, the first end portion of each rudder deflecting means being connected to an associated support member, the second end portion of each rudder deflecting means being connected to said means for forcing said second opposite ends of said support members above the surface of a body of water.

* * * * *